US006013889A

United States Patent [19]

Wieloch

[11] Patent Number: 6,013,889

[45] Date of Patent: Jan. 11, 2000

[54] METHOD FOR RETAINING A MOVABLE CONTACT IN A CIRCUIT INTERRUPTER

[75] Inventor: Christopher J. Wieloch, Brookfield, Wis.

[73] Assignee: Allen-Bradley Company, LLC, Milwaukee, Wis.

[21] Appl. No.: 08/867,366

[22] Filed: Jun. 2, 1997

[51] Int. Cl.[7] ..... H01H 33/18; H01H 9/44

[52] U.S. Cl. ..... 218/22; 218/51; 218/52; 218/59; 335/16

[58] Field of Search ..... 218/22, 30, 31, 218/33, 34, 35, 43–47, 48, 51, 52, 59, 89, 90, 101, 103, 104, 106, 107, 110; 335/16, 147, 195, 132, 201, 202

[56] References Cited

U.S. PATENT DOCUMENTS

| | | | |
|---|---|---|---|
| 4,748,305 | 5/1988 | Luginbuehl | 218/51 |
| 5,164,693 | 11/1992 | Yokoyama et al. | 335/14 |
| 5,406,440 | 4/1995 | Wieloch | 361/154 |
| 5,466,903 | 11/1995 | Faber et al. | 200/400 |
| 5,579,198 | 11/1996 | Wieloch et al. | 361/93 |
| 5,587,861 | 12/1996 | Wieloch et al. | 361/14 |
| 5,635,886 | 6/1997 | Pichard | 335/132 |
| 5,717,370 | 2/1998 | Haas | 335/132 |

*Primary Examiner*—Lincoln Donovan
*Attorney, Agent, or Firm*—Patrick S. Yoder; John M. Miller; John J. Horn

[57] ABSTRACT

A method for retaining a movable contact in a circuit interrupter is applicable to interrupters including first and second contacts, at least one of the contacts being movable. A movable element supporting the movable contact is displaceable between a conducting position wherein the movable contact abuts a cooperating contact to complete a current carrying path through the device, and a non-conducting position wherein the movable contact is electrically separated from the cooperating contact. In accordance with the method, the movable contact is displaced by an interrupt initiation device, and a carrier or retainer is displaced by gas pressure resulting from arcs generated by movement of the contact. The carrier is guided in its displacement within the device housing from a normal operating position to a retaining position. The carrier includes an abutment element that physically contacts the movable element to prevent it from rebounding into contact with the cooperating contact.

20 Claims, 7 Drawing Sheets

METHOD FOR RETAINING A MOVABLE CONTACT IN A CIRCUIT INTERRUPTER

BACKGROUND OF THE INVENTION

The present invention relates generally to the field of electrical circuit interrupter devices, such as circuit breakers, motor protectors and the like. More particularly, the invention relates to a method for moving and retaining a movable contact element in such a device in a non-conducting or circuit interrupted position.

A considerable array of devices and methods are known for interrupting electrical power between conductors. Such devices include circuit breakers of various design and construction, electric motor protectors, and other overcurrent protective devices. In general, such devices provide a path for the flow of electrical power under normal operating conditions, and a mechanism for breaking the current path in the event of an actual or anticipated overcurrent, overtemperature, or other undesirable condition. The current path is typically established by a movable element, such as a pivotable arm carrying a first contact region, and a stationary conductor coupled to a second contact region. The contact regions are brought into contact with one another during normal operation, permitting electrical power to flow through conductors coupled to the first and second contact regions. A sensing device or actuator generally detects fault conditions and triggers movement of the arm to separate the contact regions from one another, thereby interrupting the current path between the conductors. In multiphase devices of this type, a similar arrangement is provided for each phase. Moreover, in the latter case, a trip mechanism typically links the mechanical elements of each phase to ensure that power is interrupted in all phases in the event of a fault in a single phase. A toggle or catch mechanism is generally provided to guard against rebound of the movable arm and recontact of the conductive regions.

Other types of circuit interruption devices include arrangements in which a movable conductive bridge or spanner carrying a pair of contacts extends between two stationary contact regions. When the device is installed in service, source and load conductors are coupled to the stationary contact regions. The bridge serves to complete a current carrying path between the conductors in normal operation. For interruption of current an actuator or interrupt initiation device forces the bridge element away from the stationary contact regions, generating arcs between the separating regions as the bridge element is displaced. A circuit interrupter of this type is described in U.S. Pat. No. 5,579,198, issued on Nov. 26, 1996 to Wieloch et al.

In conventional circuit interrupting devices, such as circuit breakers, a mechanical or electromechanical assembly is associated with the movable contact support to catch or bias the contact support in a non-conducting position following a trip event and to retain the support in the non-conducting position until the device is manually or automatically reset. Common mechanical catch and retaining assemblies included toggle arrangements, snap-action structures and the like, designed to move rapidly to a retaining position following the trip event. An important function of such assemblies is to deploy with sufficient rapidity to prevent the movable contact from bouncing or returning to its conductive position, thereby re-establishing the current carrying path.

A goal of most circuit interrupter devices is to interrupt the current carrying path as quickly as possible in order to limit let-through energy and thereby to ensure the greatest protection for the load coupled to the device. As the response rates of interrupter designs is increased, however, the problem of catching and retaining the movable contact becomes increasingly more difficult. In particular, the retaining device must allow for extremely rapid opening of the electrical circuit, while intervening as quickly thereafter as possible to prevent the movable contact from rebounding. While advances have been made in trip and retaining devices that have enhanced their rapidity, response rates of such devices appear to be limited by their mass and complexity.

There is a need, therefore, for an improved method for interrupting current in electrical circuits and for holding or retaining a movable contact of a circuit interrupter extremely rapidly. In particular, there is a need for an improved method for preventing reclosure of the circuit. Moreover, there is a need for a circuit interrupter incorporating a novel technique for preventing rebound of a circuit interrupting element and that alleviates the inconveniences of heretofore known retaining structures, particularly with regard to their complexity, mass and response rate. Furthermore, there is a need for a method for extremely quickly interrupting current in multiple power phases and for maintaining movable contacts for such phases in their non-conducting positions until reset.

SUMMARY OF THE INVENTION

The present invention features an innovative technique for interrupting a current carrying path in an electrical circuit designed to respond to these needs. The technique employs gas pressure generated during displacement of a movable contact element in the circuit interrupter to move a retainer into a position wherein it contacts and holds the movable contact, preventing it from returning to a conducting position. The retainer may be made common to a plurality of phase sections, such as in a three phase interrupter, whereby movable contact elements for all phases are moved to and held in interrupted positions. In a preferred embodiment, a secondary response mechanism is actuated to contact the retainer and hold it in the retaining position until the device is reset.

Thus, in accordance with a first aspect of the invention, a method is provided for retaining a movable element in a circuit interrupter device. The device includes a movable contact and a stationary contact, the movable contact being supported within a housing by the movable element. The movable element is displaceable between an open position wherein the movable contact is separated from the stationary contact and a closed position wherein the movable contact is electrically coupled to the stationary contact to complete an electrical current carrying path through the device. In accordance with the method, the movable element is displaced from the closed position toward the open position to separate the movable and stationary contacts. Volumetric expansion of gas heated by separation of the movable and stationary contacts is contained within a region bounded at least partially by the housing and a movable carrier to move the carrier from an operating position to a retaining position. The movable element is contacted with a retaining element movable with the carrier to prevent return of the movable element to the closed position.

In accordance with another aspect of the invention, a method is provided for retaining a movable conductor element in a non-contact position in an electrical circuit interrupter device. The device includes an enclosure wherein a stationary contact element and a movable contact element are disposed. The movable contact element is supported for movement between a conducting position wherein a current carrying path is established between the movable and stationary contact elements and the non-contact position wherein the movable contact element is electrically separated from the stationary contact element to interrupt the current carrying path therebetween. In a first step of the method, displacement of the movable contact element from the conducting position is initiated to heat and expand gas within the enclosure. A retainer is displaced from a first operational position within the enclosure under the influence of expanding gas within the enclosure. Displacement of the retainer is directed towards a second operational position. The movable contact element is contacted with a portion of the retainer to maintain the movable element in the non-conducting position.

In accordance with another aspect of the invention, a method is provided for interrupting an electrical current carrying path in a three phase circuit interrupter. The interrupter includes three power phase sections disposed in an enclosure. Each power phase section includes a stationary contact element and a movable contact element. The movable contact element is supported for movement between a conducting position wherein the movable contact element contacts the stationary contact element to complete a current carrying path therebetween for the respective power phase section, and an interrupted position wherein the movable contact element is separated from the stationary contact element to interrupt the current carrying path for the respective power phase section. The method comprises a first step of displacing a first movable contact element of a first power phase section from its conducting position to heat and expand gas within the enclosure. Expanding gas is then directed toward a movable carrier to drive the carrier from a normal operating position to a retaining position within the enclosure. Second and third movable contact elements for second and third power phase sections are contacted by a portion of the carrier to displace the second and third movable contact elements from their respective conducting positions. In a preferred embodiment, the carrier maintains the movable contact elements in their interrupted position under the influence of gas pressure within the enclosure, at least until a secondary response mechanism can be moved to a position wherein it can retain the movable contact elements.

BRIEF DESCRIPTION OF THE DRAWINGS

The present invention will become more fully understood from the following detailed description, taken in conjunction with the accompanying drawings, wherein like reference numerals refer to like parts, in which.

DESCRIPTION OF THE PRESENTLY PREFERRED EMBODIMENTS

Figure 1:
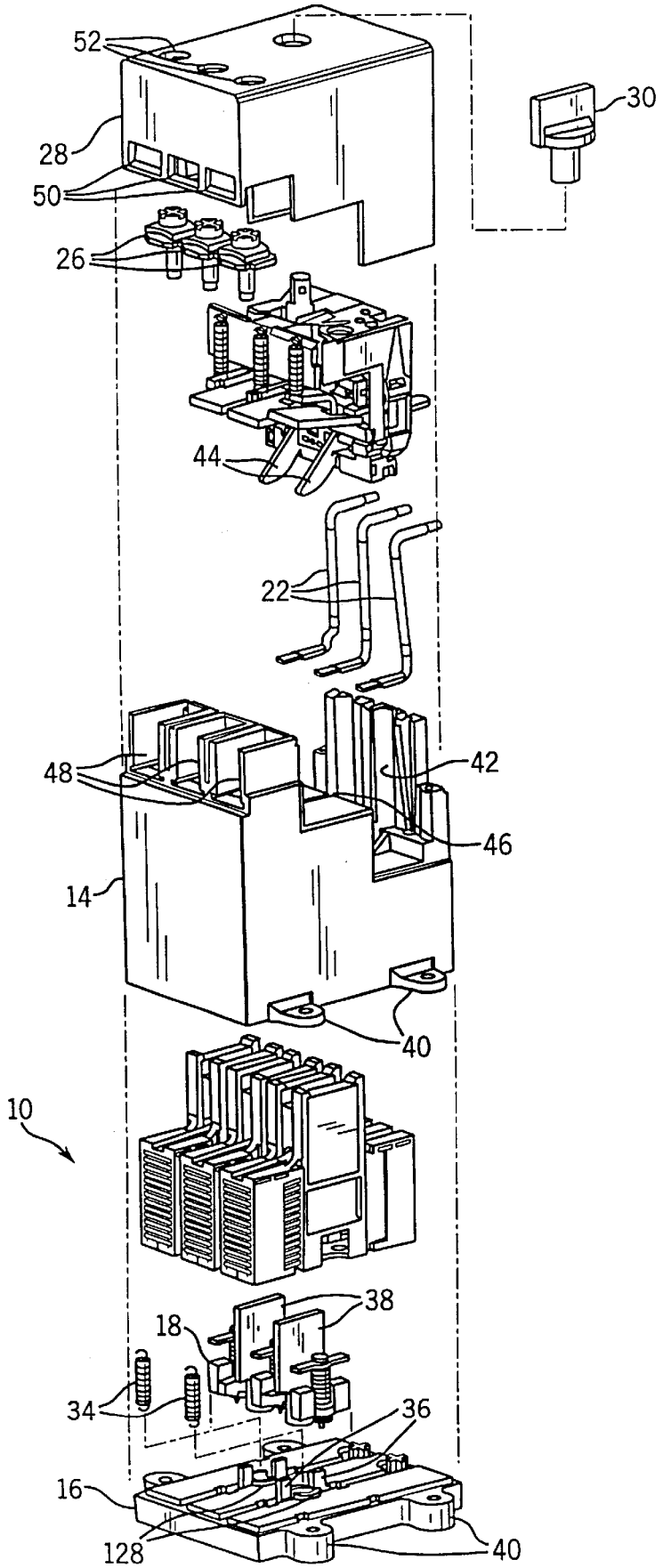
FIG. 1 is an exploded perspective view of the circuit interrupter device for interrupting electrical power in a three phase electrical circuit, illustrating the principle subassemblies of the device.

Turning now to the drawings and referring to FIG. 1, a circuit interrupter, designated generally by the reference numeral 10, is illustrated as including an interrupter module 12, an enclosure or housing 14, a base 16, a spanner/carrier assembly 18 comprising three power phase sections 20, power conductors 22, a mechanical trip/reset assembly 24, terminal assemblies 26 and a cover 28. A manual adjustment knob 30 is also illustrated in FIG. 1 and is designed to operatively fit over an adjustment stem 32 extending from assembly 24 through cover 28 when interrupter 10 is fully assembled. It should be noted that as illustrated in FIG. 1 and as described in the following discussion, interrupter 10 is preferably a three-phase device of the type used to interrupt power to three phases of electrical power. However, to the extent the structure, principles and operation of the device described below are applicable to a single power phase, those skilled in the art will readily appreciate that the device could be adapted to service a single power phase by appropriate modification of the three phase embodiment. It should also be noted that the particular internal construction of mechanical trip/reset assembly 24 does not form part of the present invention and will not be described in detail herein. Such devices are commercially available, such as from Sprecher+Schuh A. G. of Aarau, Switzerland, and generally provide rapid mechanical response to overload and overcurrent conditions and afford a ready means of displacing electrical contact elements until manually or automatically reset.

In the presently preferred embodiment, power phase sections 20 of interrupter module 12 are assembled as individual units and are inserted parallel to one another into enclosure 14, as described more fully below. Spanner/carrier assembly 18 is similarly pre-assembled and is inserted into enclosure 14, supported on base 16 by a pair of biasing springs 34. An array of guide posts 36 extend upwardly from base 16 and aid in locating assembly 18 and in guiding it through its range of movement as described below. Assembly 18 includes a pair of actuator/guide panels 38 extending upwardly into enclosure 14. Panels 38 aid in guiding assembly 18 and contact actuator levers 44 of trip/reset assembly 24 during certain phases of operation of interrupter 10. Following assembly of interrupter module 12, assembly 18 and springs 34 in enclosure 14, base 16 is secured to enclosure 14 by screws (not shown) inserted into aligning apertured tabs 40 on enclosure 14 and base 16.

It should be noted that conductors 22 are secured to power phase sections 20 prior to assembly of sections 20 in enclosure 14, and extend upwardly through the enclosure when assembled. A second conductor 58 (see FIGS. 2 and 3) also extends upwardly from each power phase section 20 as described below. Trip/reset assembly 24 is mounted in a bay 42 on enclosure 14, with actuator levers 44 extending through slots 46 provided in an upper wall of enclosure 14. Terminal assemblies 26 are secured to enclosure 14 in appropriate terminal bays 48 and are electrically coupled to second conductors 58 as described below. Cover 28 may then be placed over enclosure 14, terminal assemblies 26 and trip/reset assembly 24. Cover 28 includes conductor apertures 50 and tool apertures 52, permitting conductors (not shown) to be easily connected to terminal assemblies 26 without removal of cover 28.

Figure 2:
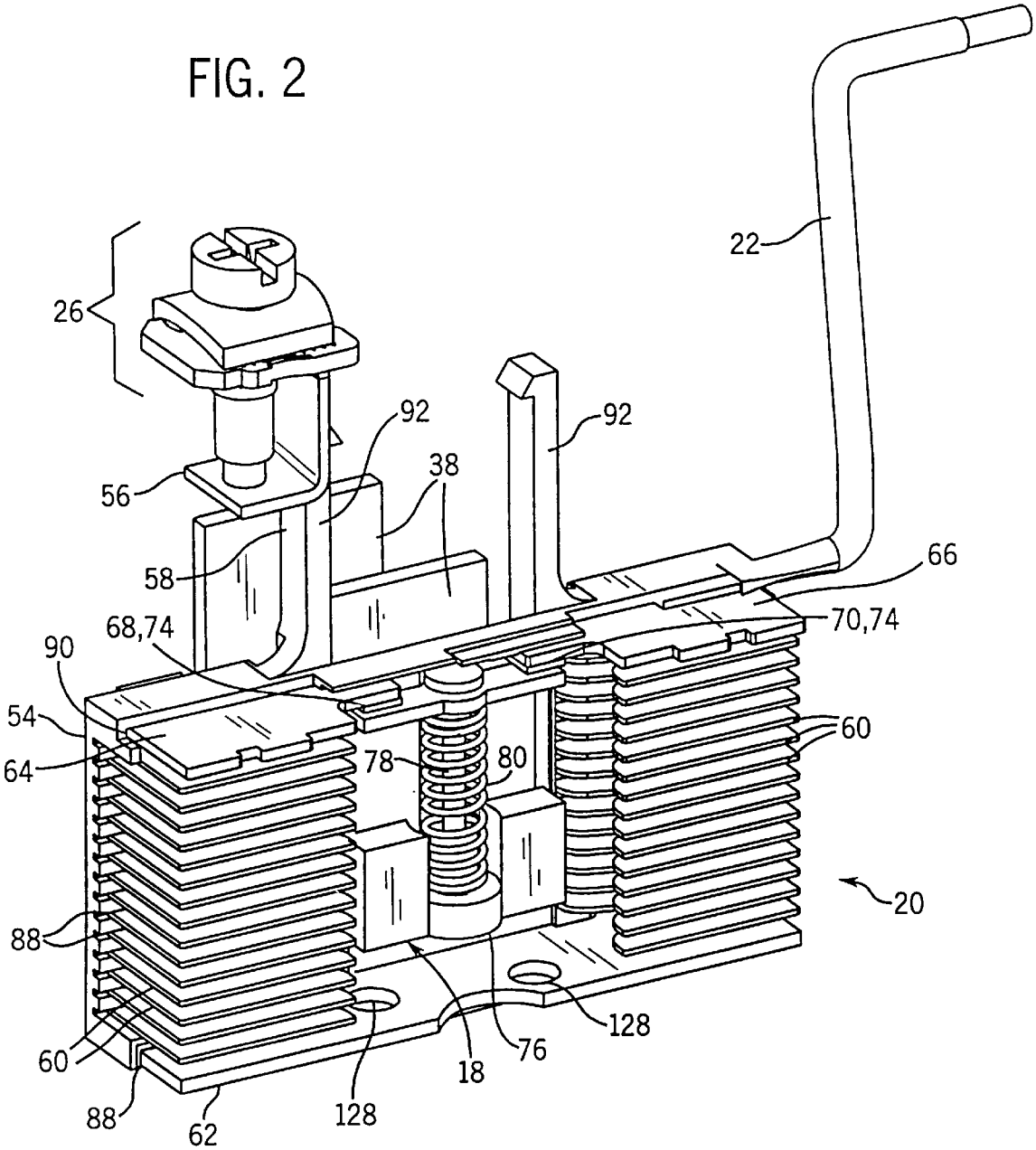
FIG. 2 is a perspective detail view of a power phase section of a circuit interrupter module of the device of FIG. 1, with a side panel of the module removed to illustrate the principle components of the power phase section of the module.
Figure 3:
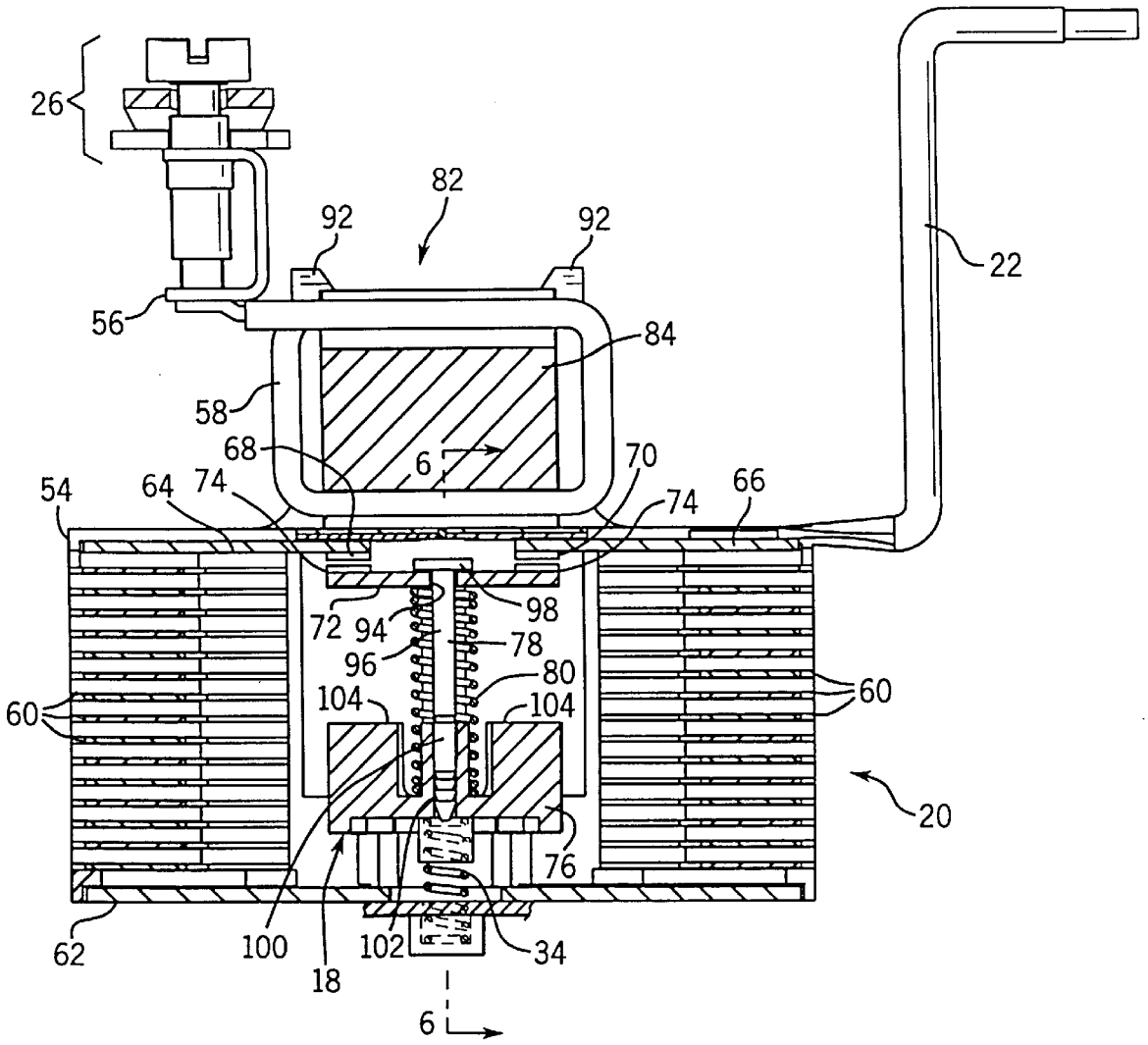
FIG. 3 is a sectional side view of the power phase section shown in FIG. 2 illustrating the electrical connections between the module and conductors for the power phase in which it would be installed.

Referring more particularly now to the preferred construction of interrupter module 12 and spanner/carrier assembly 18, FIGS. 2 and 3 illustrate the components of these assemblies in greater detail. Each power phase section 20 includes a two-piece assembly frame 54 for supporting the various elements of the section. Power is channeled to each section 20 via load side stab conductor 22, and terminal assembly 26 coupled to a connector clip 56 and therethrough to a second, line side conductor 58. Power phase section 20 includes a stack of splitter plates aligned on both line and load sides and a shunt plate 62 bounding a lower region of the section adjacent to the lower-most splitter plate. A first or line side conductive element 64 is provided atop the line side splitter plates; and a second or load side conductive element is provided in facing relation atop the load side splitter plates. Conductive elements 64 and 66 support stationary contacts 68 and 70, respectively, and are electrically coupled, such as by soldering, to line and load side conductors 58 and 22, respectively. Spanner/carrier assembly 18 includes, for each power phase section 20, a movable conductive element 72, preferably in the form of a spanner, carrying a pair of movable contacts 74 (see FIG. 3). Spanner 72 is supported on a carrier 76 via a pin 78, described more fully below, and is biased into a conducting position by a compression spring 80. In the conducting position of spanner 72, movable contacts 74 abut against stationary contacts 68 and 70 to complete a current carrying path through the power phase section between conductors 58 and 22.

Each power phase section 20 also includes an interrupt initiation device 82, preferably including an electromagnetic core 84 for initiating movement of spanner 72 from its conducting position to an interrupted position in response to overload or overcurrent conditions in the current carrying path defined by spanner 72. Core 84 is preferably configured as set forth in U.S. Pat. No. 5,579,198 issued on Nov. 26, 1996 to Wieloch et al., which is hereby incorporated herein by reference. As illustrated in FIG. 3, at least one of conductors 58 and 22 is preferably wound at least one turn around core 84 to aid core 84 in producing an electromotive force for repelling spanner 72 from its conducting position. In the preferred embodiment, line side conductor 58 encircles core 84 approximately one and three-quarters turns between connector clip 56 and its point of attachment to conductive element 64.

As best illustrated in FIG. 2, assembly frame members 54 of each power phase section 20 preferably include molded features designed to support the components described above. For example, frame 54 includes splitter plate support slots 86 arranged along either side of the section, and a shunt plate recess 88 along a bottom edge. Stationary element support slots 90 are provided near an upper end of each frame 54 for receiving and supporting stationary conductive elements 64. Interrupt initiation device support arms 92 extend upwardly from slots 90 to receive and support interrupt initiation device 82. Moreover, internal surfaces of frame members 54 preferably define guides for spanner 72 to prevent rotation of spanner 72 as it is displaced along pin 78 as described below.

A central aperture 94 is formed through spanner 72 for slidingly receiving pin 78. As best illustrated in FIG. 3, pin 78 includes a shank 96 extending through aperture 94, and a head 98 capturing spanner 72 on shank 96. A base 100 of pin 78 is anchored in a pin support recess 102 of carrier 76. Carrier 76 also includes a pair of abutment or support shoulders 104 for contacting spanner 72 in the event of high velocity displacement of spanner 72 as described below. Shoulders 104 define a spring recess 106 of sufficient depth to fully receive spring 80 in a compressed state in the event spanner 72 is driven fully into contact with shoulders 104.

Figure 5:
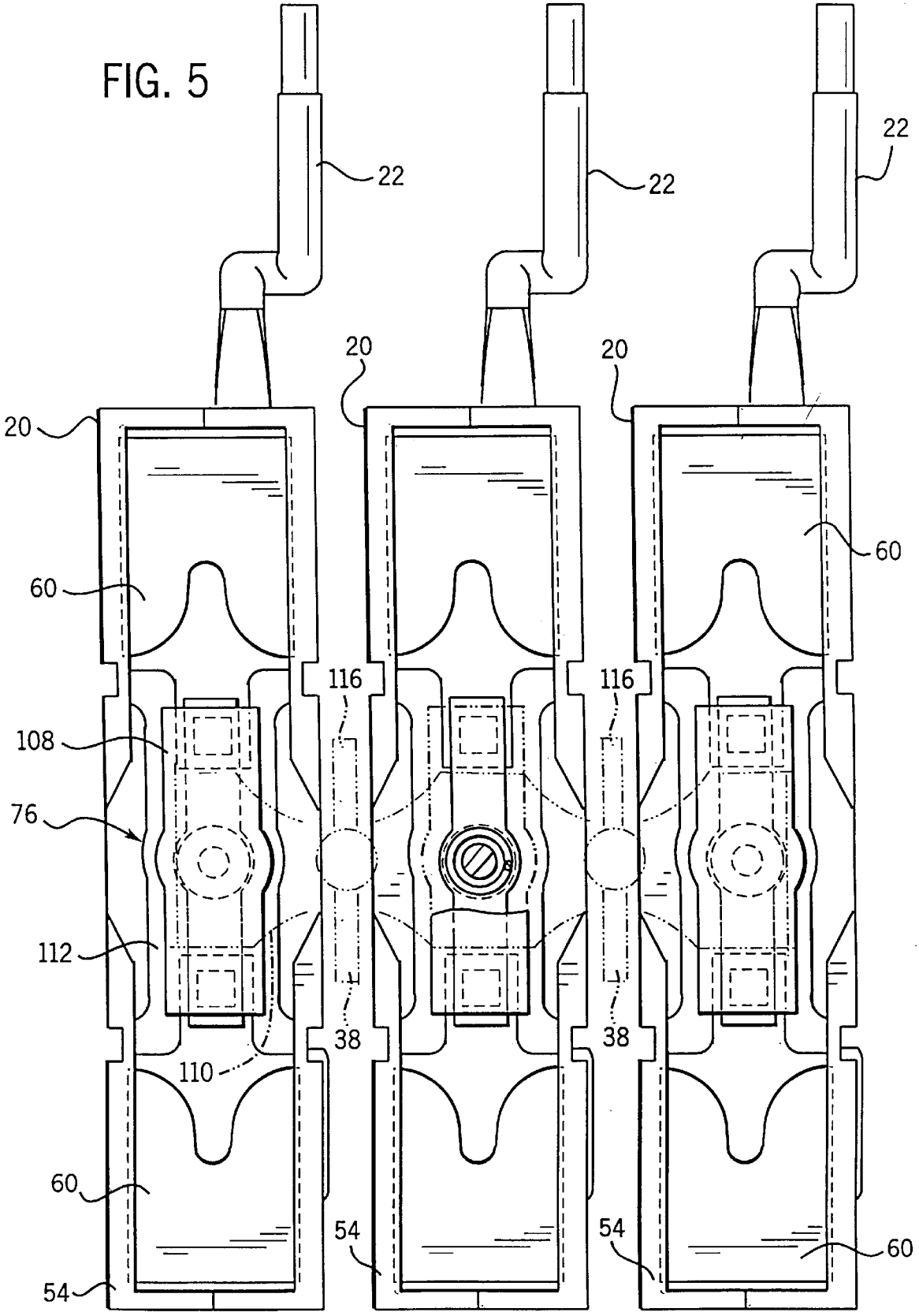
FIG. 5 is an end view of the modules and enclosure of FIG. 4 with the carrier or retainer assembly slidably positioned therein.
Figure 6:
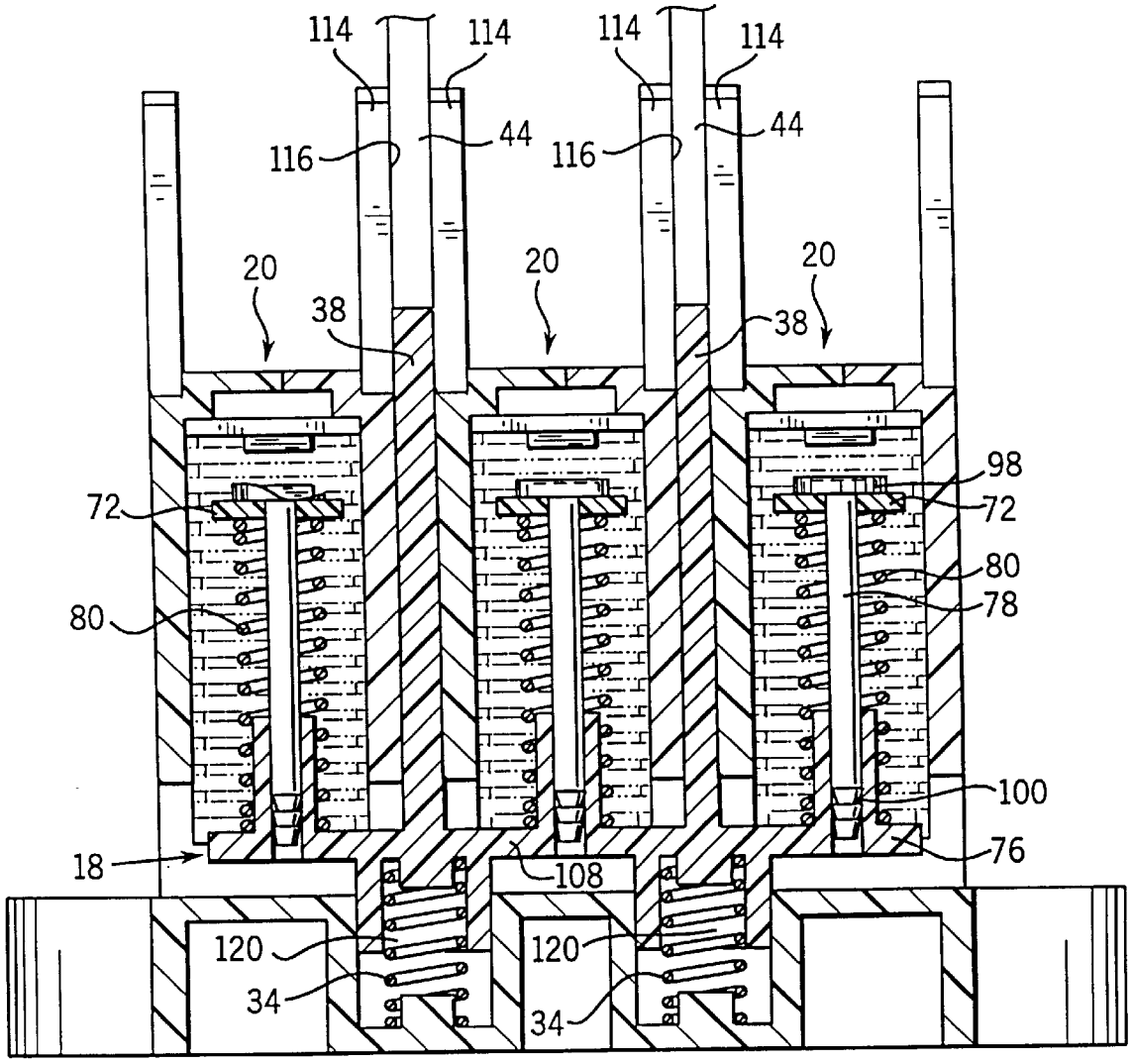
FIG. 6 is a sectional view through the interrupter module and retainer spanner/carrier assembly of FIG. 1 along line 6—6, showing the physical arrangement of the interrupter components.

While the components described above for each power phase section 20 are generally independent for each section, carrier 76 is preferably common to all power phase sections 20. Thus, as shown in FIGS. 5 and 6, carrier 76 includes a base panel 108 extending below the three power phase sections 20. Base panel 108 has an external profile, designated by the reference numeral 110, which conforms to a peripheral shape of an internal cavity 112 of the power phase sections when installed in enclosure 14. A plurality of internal walls or dividers 114 are provided within enclosure 14 for supporting power phase sections 20 and for defining the peripheral shape of internal cavity 112. Moreover, internal walls 114, along with assembly frames 54 define elongated slots 116 for receiving and guiding actuator/guide panels 38 of carrier 76. Cavity 112 is sized so as to be generally closed by carrier 76, but to permit sliding movement of carrier within cavity 112.

Figure 4:
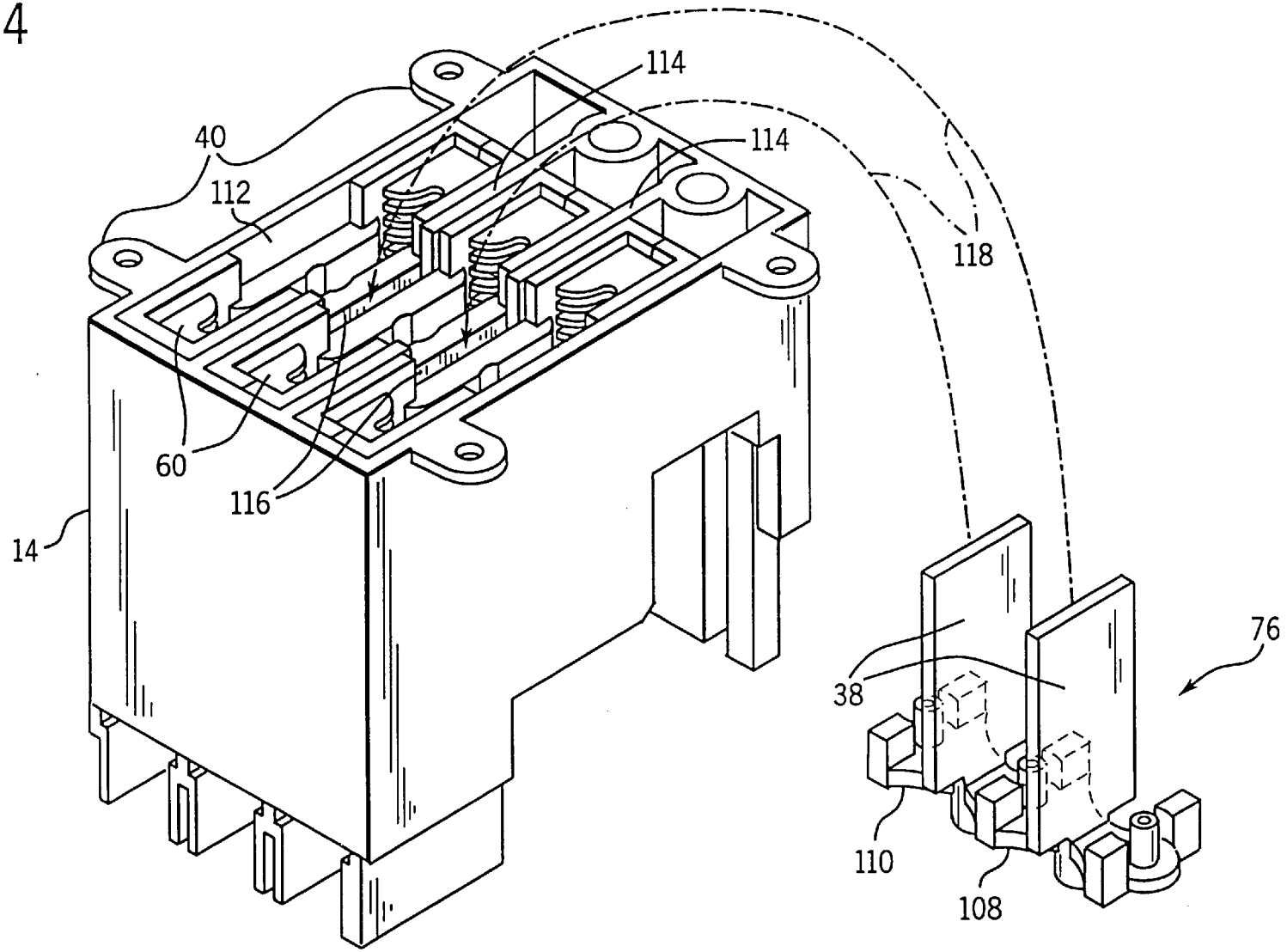
FIG. 4 is a perspective end view of a series of circuit interrupter modules in an enclosure and of a carrier or retainer assembly designed to fit within the enclosure.

For assembly, actuator/guide panels 38 are aligned with slots 116, as indicated by arrow 118 in FIG. 4, and spanner/carrier assembly 18 is slid into place within enclosure 14, placing movable contacts 74 for each power phase section 20 in mutually facing relation with stationary contacts 68, 70 for the respective power phase section (see FIG. 3). As shown in FIG. 5, once placed in enclosure 14, carrier base 108 covers or bounds a lower extremity of cavity 112. To complete assembly, shunt plates 62 are placed over each cavity 112, springs 34 are positioned in appropriate locations 120 on a bottom side of carrier base 108 and base 16 is fixed in place to close the enclosure.

FIG. 6 illustrates a side sectional view of the internal components described above following their assembly in interrupter 10. As shown in FIG. 6, once assembled, power phase sections 20 are separated within enclosure 14 by internal walls 114. Spanner/carrier assembly 18 is urged upwardly by springs 34 and, from carrier base 108, the spanner 72 of each power phase section 20 is urged upwardly into its conducting position by springs 80, placing movable contacts 74 in abutting relation with stationary contacts 68 and 70, and completing a current carrying path between conductors 58 and 22 (see FIG. 3). Moreover, within enclosure 14, actuator/guide panels 38 are lodged slidingly within guide slots 116. Adjacent to and above panels 38 in guide slots 116 are actuator levers 44 of trip/reset assembly 24.

In operation, spanner/carrier assembly 18 is urged upwardly into its normal operating position as shown in FIG. 6 by springs 34. Spanners 72 are similarly urged upwardly by springs 80, pressing movable contacts 74 into abutment with stationary contacts 68 and 70 to complete a current carrying path through each power phase section 20. It should be noted that pins 78 are of sufficient length that when carrier 76 is in its raised or biased position shown in FIG. 6, spanners 72 may be brought into contact with stationary contacts 68 and 70 without interference from pin head 98.

When a rapid overcurrent condition occurs in any one of the power phase sections, current through conductor 58 of that section generates an electromagnetic field which is intensified and directed by interrupt initiation device 82. This field acts to repel the spanner for the power phase section in which the overcurrent condition occurred, rapidly moving the spanner from its conducting position against the force of spring 80. In the presently preferred embodiment illustrated, arcs are generated between movable contacts 74 and stationary contacts 68 and 70 during movement of a spanner from its conducting position. Conductive elements 64 and 66 serve as arc runners during this phase of operation, routing expanding arcs toward splitter plates 60 on either side of spanner 72. The slight inertia of spanner 72 allows the spanner to move extremely rapidly from its conducting position, resulting in very rapid expansion of the arcs between the movable and stationary contacts, tending to extinguish the arcs. Each interrupter power phase section 20 preferably operates generally in accordance with the method set forth in U.S. Pat. No. 5,587,861 issued on Dec. 24, 1996 to Wieloch et al., which is hereby incorporated herein by reference.

It should be noted that, although in the preferred embodiment movable conductive element 74 is a spanner which is electrically and physically separated from both stationary contacts in its interrupted position, the retaining technique described herein could also be utilized with structures in which a movable element is separated from a single stationary contact, such as in rocker-type devices. Moreover, those skilled in the art may envision various alternative structures for contacting the movable element with a carrier or retainer in accordance with the principles described below without departing from the spirit and scope of the appended claims.

In addition to aiding in driving spanner 72 from its conducting position and rapidly limiting let-through energy, arcs generated during movement of movable contacts 74 from stationary contacts 68 and 70 heat gases within interrupter 10 and thereby aid in retaining spanners in interrupted positions separated from their stationary contacts. In particular, gases confined within internal cavity 112 are heated by arcs resulting from separation of the spanner of any one of power phase sections 20, creating pressure within enclosure 14. Such expanding gases contact carrier base 108 and rapidly drive carrier 76 downwardly toward base 16, against the force of springs 34. Carrier 76 in turn transports pins 78 of each power phase section downwardly, catching the spanner displaced by the electromotive force of its interrupt initiation device against head 98. In the preferred embodiment illustrated, wherein carrier 76 is common to three power phase sections, carrier pins 78 for power phases not initially interrupted by the overcurrent event also contact their respective spanners during displacement of carrier 76, thereby interrupting power to those power phase sections as well.

Figure 7A:
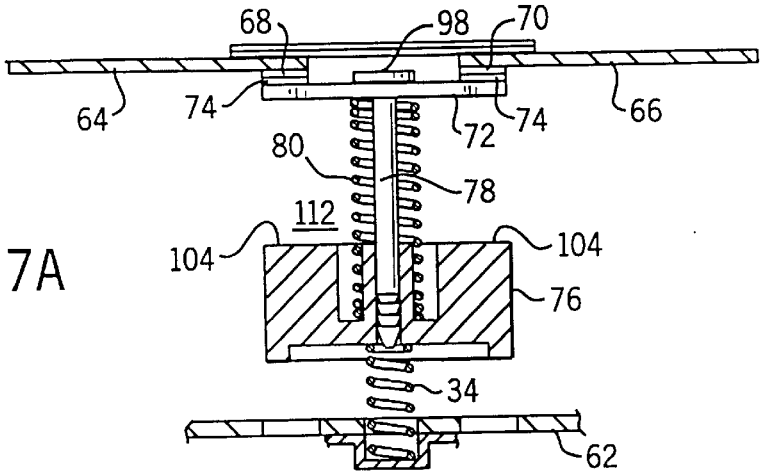
FIGS. 7A–7C are diagrammatical side views of the elements of one power phase section of the module, illustrating, respectively, the movable contact element in its closed or conducting position prior to a trip event, in an intermediate position after initial displacement during a trip event, and in an interrupted position, after displacement of the carrier.
Figure 7B:
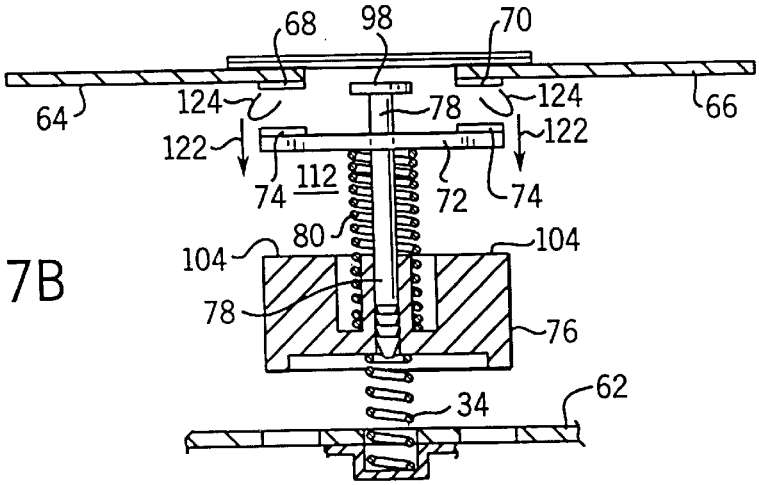
Figure 7C:
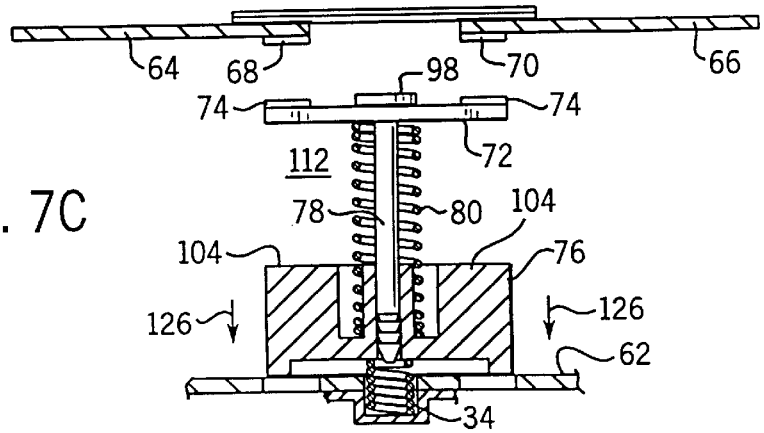

The basic phases of this process are illustrated diagrammatically in FIGS. 7A–7C. FIG. 7A represents carrier 76 in its biased or normal operating position and a spanner 72 in its biased or conductive position prior to a trip event. As shown in FIG. 7B, once the interrupt initiation device initiates separation of spanner 72 from its conductive position as indicated by arrows 122, spanner 72 slides downwardly along pin 78 and arcs 124 are generated between movable contacts 74 and stationary contacts 68 and 70. These arcs expand rapidly due to the high velocity of spanner 72 and heat gases within cavity 112. As shown in FIG. 7C, pressure resulting from these gases drives carrier 76 downwardly, as indicated by arrows 126, against the force of springs 34 until carrier base 108 contacts shunt plates 62 (or base 16). In this lowered or retaining position of carrier 76, head 98 of pin 78 contacts an upper side of spanner 72, restraining spanner 72 from rebounding and recontacting stationary contacts 68 and 70. If spanner 72 is displaced with sufficient force, spanner 72 may contact shoulders 104 of carrier 76, protecting spring 80 from being crushed or damaged.

It should be noted that, while sufficient clearance is provided within cavity 112 for relatively free sliding movement of carrier 76, carrier base 108 fits sufficiently tightly within cavity 112 to displace carrier 76 before gas pressure can dissipate following generation of arcs from displacement of a spanner. Moreover, vents 128 are preferably provided in base 16, behind carrier base 108, through which gases eventually dissipate following displacement of carrier 76. Thus, carrier 76 is driven into its retaining position by expanding gases within enclosure 14 and is held in the retaining position for the period of time necessary for gas pressure to dissipate by leakage around carrier base 108 and through vents 128 (see FIGS. 1 and 2), and any other openings in enclosure 14. Eventually, as gas pressure dissipates within enclosure 14, springs 34 will overcome forces against carrier 76 resulting from the gas pressure, and carrier 76 will again return to its biased position, thereby resetting interrupter 10.

While the dissipation of gas pressure within enclosure 14 may be used to reset interrupter 10, in the preferred embodiment illustrated, mechanical trip/reset assembly 24 is preferably also tripped following an overcurrent condition. Tripping of assembly 24 results in movement of actuator levers 44 downwardly within guide slots 116 (see FIG. 6), to a point where actuator levers 44 contact actuator/guide panels 38 of carrier 76 to hold carrier 76 in its interrupted or retaining position. Response of assembly 24 preferably occurs prior to dissipation of gas pressure within enclosure 14 sufficient to permit return of carrier 76 to its normal or biased position. Once tripped, assembly 24 will hold carrier 76 in the retaining position until reset in a conventional manner via knob 30. It should also be noted that, while spanner 72 and carrier 76 are designed to respond extremely quickly to overcurrent conditions, mechanical trip/reset assembly 24 is adapted to respond to more slowly occurring conditions, such as thermal overloads.

While the embodiments illustrated in the Figures and described above are presently preferred, it should be understood that these embodiments are offered by way of example only and may be adapted to various other structures.

What is claimed is:

1. A method for retaining a movable element in a circuit interrupter device, the device including a movable contact and a stationary contact, the movable contact being supported within a housing by the movable element, the movable element being displaceable between an open position wherein the movable contact is separated from the stationary contact and a closed position wherein the movable contact is electrically coupled to the stationary contact to complete an electrical current carrying path through the device, the method comprising the steps of:

(a) displacing the movable element from the closed position toward the open position to separate the movable and stationary contacts;

(b) containing volumetric expansion of gas heated by separation of the movable and stationary contacts within a region bounded at least partially by the housing and a movable carrier whereby the expanding gas acts on the carrier to move the carrier from an operating position to a retaining position; and (c) contacting the movable element with a retaining element secured to and movable with the carrier to prevent return of the movable element to the closed position under the influence of the gas.

2. The method of claim 1, wherein prior to step (a), the carrier is biased into the operating position and the movable element is biased into the closed position.

3. The method of claim 1, including the further step of venting the gases from the housing following step (c).

4. The method of claim 3, wherein the gases are vented at least partially via at least one vent located adjacent to the carrier.

5. The method of claim 1, wherein the circuit interrupter device is a three phase interrupter including stationary contacts, movable contacts and retaining elements for each of three phases of electrical power, and wherein the steps of the method are performed for a first phase of the three phases.

6. The method of claim 5, wherein the carrier is common to the three phases, such that movement of the carrier displaces of movable elements of second and third phases not displaced in step (a).

7. The method of claim 1, wherein in step (a), the movable element is displaced by an interrupt initiation device coupled to the current carrying path.

8. The method of claim 7, wherein the interrupt initiation device displaces the moveable element via electromotive forces resulting from an overcurrent condition in the current carrying path.

9. A method for retaining a movable conductor element in a non-conducting position in an electrical circuit interrupter device, the device including an enclosure and a stationary contact element and a movable contact element disposed within the enclosure, the movable contact element being supported for movement between a conducting position wherein a current carrying path is established between the movable and stationary contact elements and the non-conducting position wherein the movable contact element is electrically separated from the stationary contact element to interrupt the current carrying path therebetween, the method including the steps of:

(a) initiating displacement of the movable contact element from the conducting position to heat and expand gas within the enclosure;

(b) displacing a retainer from a first operational position within the enclosure under the influence of expanding gas within the enclosure;

(c) guiding displacement of the retainer towards a second operational position; and (d) contacting the movable contact element with a portion of the retainer to maintain the movable element in the non-conducting position under the influence of pressure exerted by the gas.

10. The method of claim 9, comprising the further step of displacing a secondary response mechanism to maintain the movable contact element in the non-contact position.

11. The method of claim 9, wherein the movable contact element and the retainer are biased towards the conducting position and the first operational position, respectively.

12. The method of claim 9, wherein the device comprises a second stationary contact element and the movable contact element contacts both stationary contact elements in the conducting position and is separated from both stationary contact elements in the non-conducting position.

13. The method of claim 9, wherein the movable contact element is displaced in step (a) by electromotive forces generated by an electromagnetic element disposed adjacent to the movable contact element.

14. The method of claim 13, wherein at least one conductor is coupled to the stationary contact and is wound around the electromagnetic element at least one turn, the electromotive forces displacing the movable contact element resulting from an overcurrent condition in the conductor.

15. The method of claim 9, wherein the circuit interrupter device is a three phase interrupter including stationary contacts, movable contacts and retaining elements for each of three phases of electrical power, and wherein the steps of the method are performed for a first phase of the three phases.

16. The method of claim 15, wherein the retainer is common to the three phases, such that movement of the retainer displaces movable elements of second and third phases not displaced in step (a).

17. A method for interrupting an electrical current carrying paths in a three phase circuit interrupter, the interrupter including three power phase sections disposed in an enclosure, each power phase section including a stationary contact element and a movable contact element, the movable contact elements being supported for movement between a conducting position wherein the movable contact element contacts the stationary contact element to complete a current carrying path therebetween for the respective power phase section, and an interrupted position wherein the movable contact element is separated from the stationary contact element to interrupt the current carrying path for the respective power phase section, the method comprising the steps of:

(a) displacing a first movable contact element of a first power phase section from its conducting position to heat and expand gas within the enclosure;

(b) directing expanding gas toward a movable carrier to drive the carrier from a normal operating position to a retaining position within the enclosure under the influence of the expanding gas; and (c) contacting second and third movable contact elements for second and third power phased sections by a portion of the carrier to displace the second and third movable contact elements from their respective conducting positions.

18. The method of claim 17, comprising the further step of maintaining contact between the carrier and the first, second and third movable contact elements to prevent return of the movable contact elements to their respective conducting positions.

19. The method of claim 17, wherein each power phase section includes a second stationary contact element and the movable contact element of each power phase section spans between the stationary contact elements of the respective power phase section its conducting position.

20. The method of claim 17, comprising the further step of displacing a secondary response mechanism to maintain the first, second and third movable contact elements in their respective interrupted positions.

* * * * *